US007527520B2

(12) United States Patent
Nitobe

(10) Patent No.: US 7,527,520 B2
(45) Date of Patent: May 5, 2009

(54) CABLE TYING APPARATUS AND ELECTRONIC DEVICE HAVING CABLE TYING APPARATUS

(75) Inventor: Kenji Nitobe, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 493 days.

(21) Appl. No.: 11/495,083

(22) Filed: Jul. 28, 2006

(65) Prior Publication Data

US 2007/0193002 A1 Aug. 23, 2007

(30) Foreign Application Priority Data

Feb. 23, 2006 (JP) ..... 2006-046849

(51) Int. Cl.
*H01R 13/58* (2006.01)

(52) U.S. Cl. ..... 439/464

(58) Field of Classification Search ..... 439/451, 439/460, 464, 465, 719
See application file for complete search history.

(56) References Cited

U.S. PATENT DOCUMENTS 3,794,960 A * 2/1974 Sugar ..... 439/464
3,874,765 A * 4/1975 Gilmore et al. ..... 439/464
3,936,129 A * 2/1976 Guy ..... 439/464
5,211,706 A * 5/1993 Polgar ..... 439/464

FOREIGN PATENT DOCUMENTS

| | | |
|---|---|---|
| JP | 8-7662 | 3/1996 |
| JP | 2587372 | 10/1998 |
| JP | 2005-051003 | 2/2005 |

* cited by examiner

*Primary Examiner*—Tho D Ta
(74) *Attorney, Agent, or Firm*—Blakely, Sokoloff, Taylor & Zafman LLP

(57) ABSTRACT

According to one embodiment, a cable tying apparatus includes a band attachment part having an insertion part where a tie-band for tying cables is inserted, a lead-out part, and an opening that separates the insertion part and the lead-out part, and a tying part that is installed on the band attachment part. The insertion part has a first end that continues to the opening, while the lead-out part has a second end that continues to the opening, and the second end is offset from the first end in the direction of moving away from the tying part.

20 Claims, 7 Drawing Sheets

CABLE TYING APPARATUS AND ELECTRONIC DEVICE HAVING CABLE TYING APPARATUS

CROSS-REFERENCE TO RELATED APPLICATIONS

This application is based upon and claims the benefit of priority from the prior Japanese Patent Application No. 2006-46849, filed Feb. 23, 2006, the entire contents of which are incorporated herein by reference.

BACKGROUND

1. Field

Embodiments of the present invention relate to a cable tying apparatus that ties cables, such as those for telephone lines, to its band attachment part by means of a tie-band, and an electronic device having such cable tying apparatus.

2. Description of the Related Art

Control boxes that connect to telephone lines, for example, all have an enclosure into which multiple cables are guided. This type of enclosure is integrally molded using synthetic resin material, and a band attachment part that ties multiple cables into a single bundle and thereby retains the cables is formed inside the enclosure.

Conventional band attachment parts comprise a flat affixed part provided at the bottom of the enclosure, a guide groove integrally molded in this affixed part, and a guide tube that rises from one end of this guide groove.

The guide groove has a bottom that is formed wider than the tie-band used for tying cables and a pair of side walls that respectively rise from the rims on both sides of this bottom, and opens toward a position above the affixed part. A part of the top rim of each side wall has a stopper piece formed on it. This stopper piece is used to prevent the tie-band from coming off of the guide groove, and extends into the guide groove from the top rim of each side wall. A mold removal hole is formed in the bottom of the guide groove. This mold removal hole opens into the guide groove in a manner facing the stopper pieces.

The guide tube is used to guide a tie-band into the guide groove, and the top edge of the guide tube has an inlet through which to insert a tie-band. This inlet is formed in a manner tilting toward the projecting direction of the guide tube so that a tie-band can be inserted easily. For this reason, the opening area of the inlet expands along the projecting direction of the guide tube, while the bottom rim of the inlet is located closely to the guide groove.

Cables to be tied are placed on the side walls of the guide groove in the direction roughly perpendicular to the guide groove. A tie-band is inserted into the inlet in the guide tube in this condition where the cables are placed on the side walls. The tie-band that has been inserted into the inlet is guided to one end of the guide groove via the guide tube, and let travel between the bottom of the guide groove and the stopper pieces to be finally drawn out to above the guide groove. When the tie-band is formed into a loop and tightened in this condition, the multiple cables are tied into a single bundle and retained to the band attaching part of the enclosure (refer to Jpn. Pat. Appln. KOKAI Publication No. 2005-51003).

According to the band attachment part disclosed in the above-identified Japanese patent application, the inlet into which a tie-band is inserted is formed in a manner tilting toward the projecting direction of the guide tube, while the opening area of the inlet expands along the projecting direction of the guide tube.

In this configuration, the expanding inlet allows a tie-band to be inserted into the inlet in various orientations. Accordingly, it is possible, for example, that inserting a tie-band at a near-horizontal angle from a point close to the bottom edge of the inlet will cause the tip of the tie-band to lift from the guide groove and pass over the stopper pieces.

If this occurs, the tie-band can no longer be tightened in a loop covering the guide tube and stopper pieces, and the tie-band ends up being improperly attached to the band attachment part. Consequently, the cables may not be tied securely depending on the diameter of the bundled cables, and the cables may move in the axial direction.

Furthermore, inserting a tie-band from directly above the inlet, for instance, will cause the tip of the tie-band to contact the bottom of the guide groove at a near-perpendicular angle. When this occurs, the tip of the tie-band gets caught at the bottom of the guide groove and this obstructs smooth insertion of the tie-band.

At the same time, the mold removal hole provided in the bottom of the guide groove may cause the tip of the inserted tie-band to get caught by this mold removal hole or even enter the hole. Particularly when the tie-band enters the hole, the tie-band will project out of the enclosure through the hole, in which case the cables can no longer be tied.

DETAILED DESCRIPTION

Hereinafter, embodiments of the present invention will be described with reference to the drawings.

Figure 1:
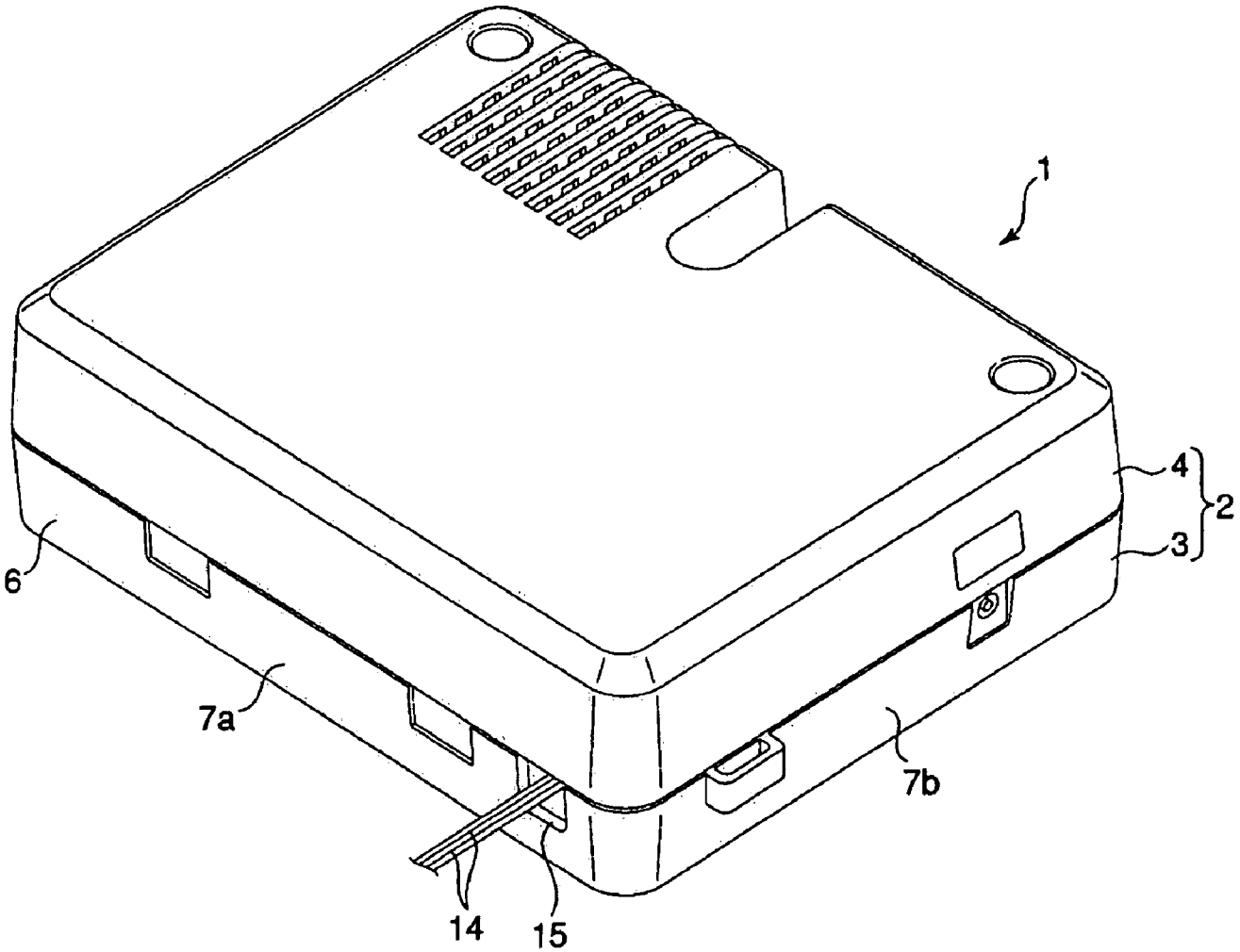
FIG. 1 is an exemplary perspective view showing a control box conforming to the first embodiment of the present invention.
Figure 2:
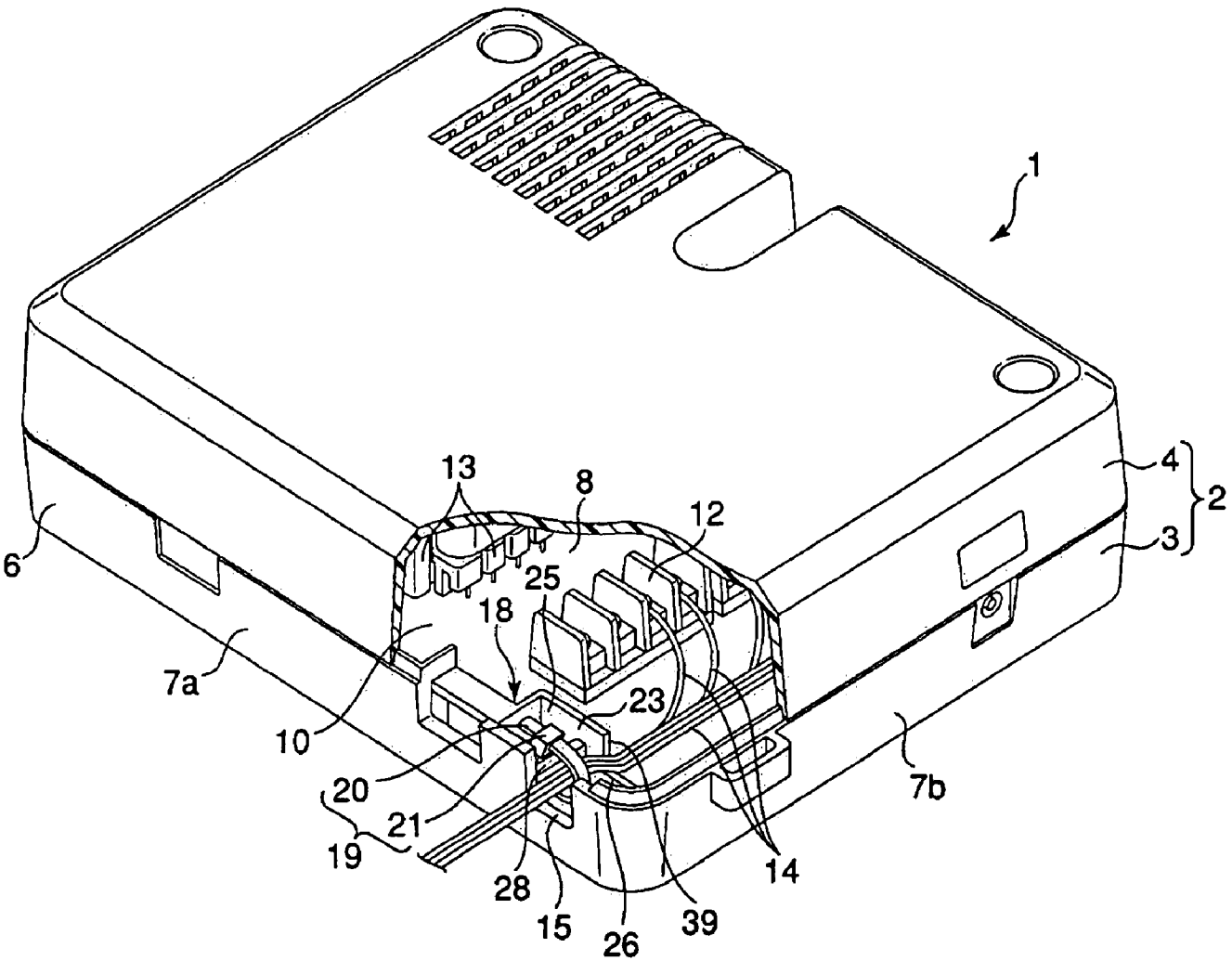
FIG. 2 is an exemplary perspective view of a control box in which a plurality of cables are tied and retained at a band attachment part in conformance with the first embodiment of the present invention.

FIGS. 1 and 2 disclose a control box 1 for telephone lines as an example of electronic device. The control box 1 is used to relay a telephone and an external speaker, for example, and has a box-shaped enclosure 2.

The enclosure 2 includes a base 3 and a top cover 4. The base 3 and top cover 4 are integrally formed by injection molding using synthetic resin material, respectively. The base 3 and top cover 4 are injection-molded using a die structure combining cavity and core (not illustrated).

The base 3 includes a square bottom wall 5 and peripheral walls 6 that rise from the periphery of the bottom wall 5. The peripheral walls 6 have a pair of first walls 7*a* extending in the width direction of the base 3 (only one first wall is illustrated) and a pair of second walls 7*b* extending in the depth direction of the base 3 (only one second wall is illustrated), with all walls provided contiguously in the circumferential direction of the base 3.

The top cover 4 is removably placed over the base 3. The top cover 4, together with the base 3, forms a storage chamber 8 inside the enclosure 2.

As shown in FIG. 2, a printed circuit board 10 is housed inside the storage chamber 8 in the enclosure 2. The printed circuit board 10 is affixed on a plurality of bosses 11 projecting from the bottom wall 5 of the base 3 (only one boss is shown in each of FIGS. 5 through 7), and is retained horizontally along the bottom wall 5.

A cable connector 12 and a plurality of circuit components 13 are mounted on the top surface of the printed circuit board 10. The cable connector 12 is used to connect a plurality of cables 14 leading from a telephone, switchboard or external speaker, for example. The cables 14 are guided through a cable lead-in hole 15 that opens in the first wall 7*a* of the base 3, and led into the storage chamber 8 in the enclosure 2. The cables 14 extend along the direction roughly perpendicular to the first wall 7*a*.

Figure 3:
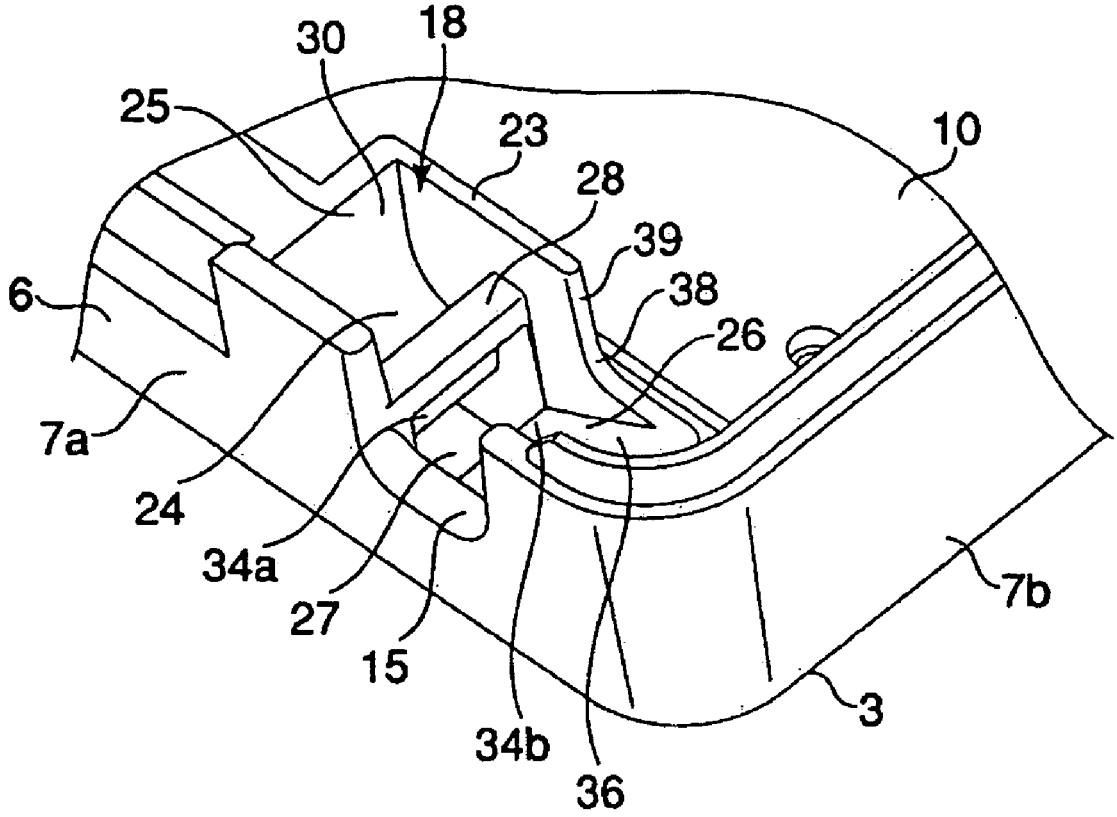
FIG. 3 is an exemplary perspective view of a band attachment part conforming to the first embodiment of the present invention.
Figure 4:
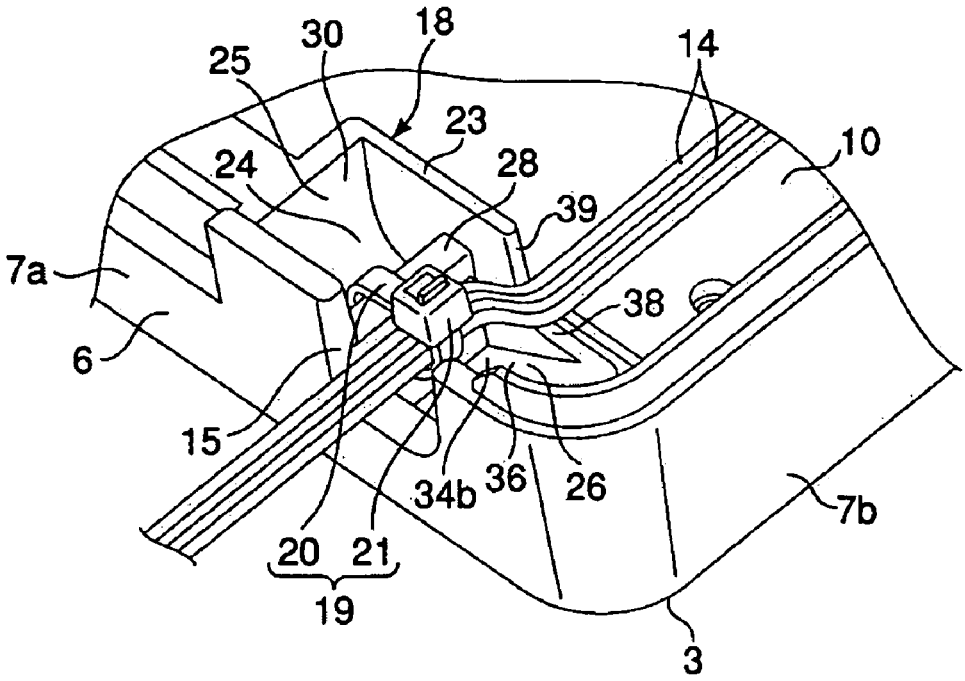
FIG. 4 is an exemplary perspective view showing a plurality of cables tied and retained using a tie-band at a band attachment part in conformance with the first embodiment of the present invention.

As shown in FIGS. 2 through 4, the base 3 of the enclosure 2 includes a band attachment part 18. The band attachment part 18 is used in conjunction with a tie-band 19 made of, say, synthetic resin, to tie the plurality of cables 14. The band attachment part 18 is formed integrally inside the base 3 and arranged side by side with the cable lead-in hole 15.

Figure 6:
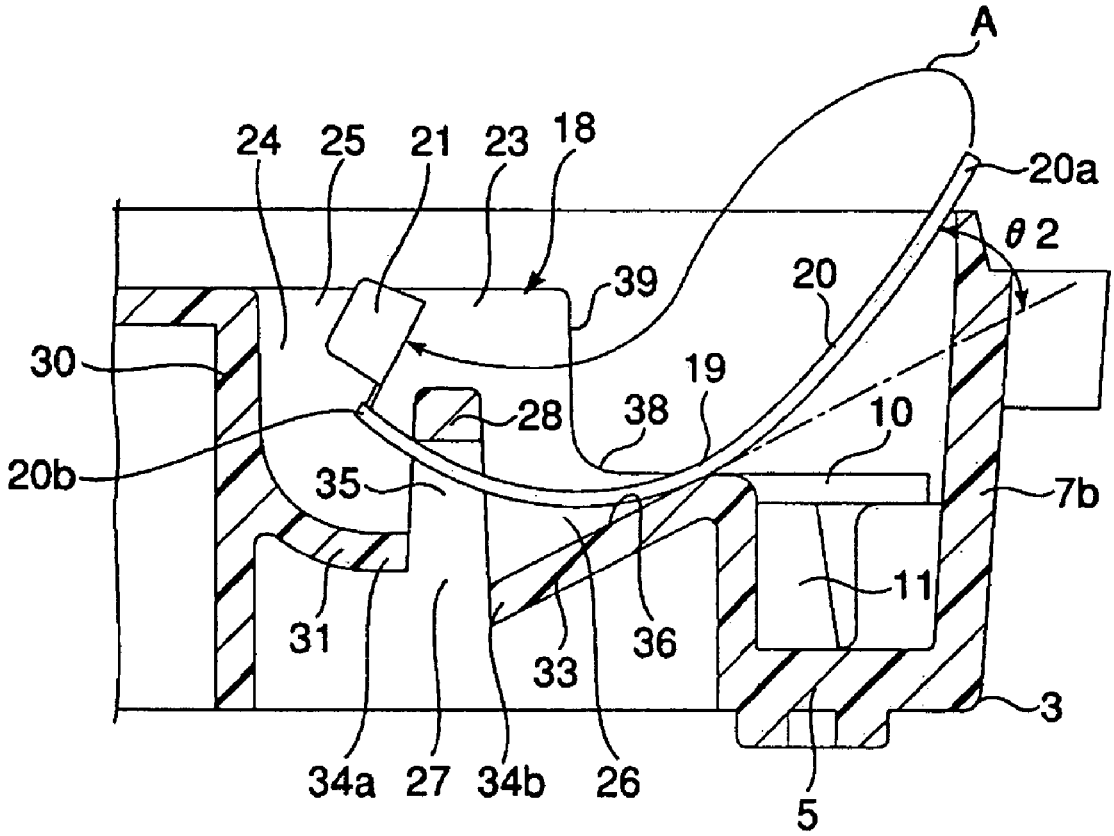
FIG. 6 is an exemplary cross-section view of a band attachment part where a tie-band is projecting over a base in conformance with the first embodiment of the present invention.

As shown in FIGS. 4 and 6, the tie-band 19 includes a band 20 and a latch 21. The band 20 is flexible and provided as a strip that has a sufficient length to tie the plurality of cables 14 into a single bundle. The band 20 includes a tip 20*a* positioned on the insertion side of the tie-band 19, and an opposite tip 20*b* positioned on the opposite side of the tip 20*a*.

The latch 21 is integrally formed with the opposite tip 20*b* of the band 20. The latch 21 forms a tubular shape through which the band 20 can be inserted. Therefore, inserting the tip 20*a* of the band 20 into the latch 21 and then pulling the band will form a loop of the tie-band 19. At the same time, the band 20 gets caught at the latch 21. This mechanism has the effect of preventing the band 20 from coming off and thereby allowing the tie-band 19 to maintain a loop shape.

The band attachment part 18 has an opposing wall 23 that faces the first wall 7*a* of the base 3. The opposing wall 23 rises from the bottom wall 5 of the base 3 and forms a groove 24 between itself and the first wall 7*a* through which the tie-band 19 is guided. The groove 24 extends in the width direction of the base 3 and opens toward a position above the base 3.

Figure 5:
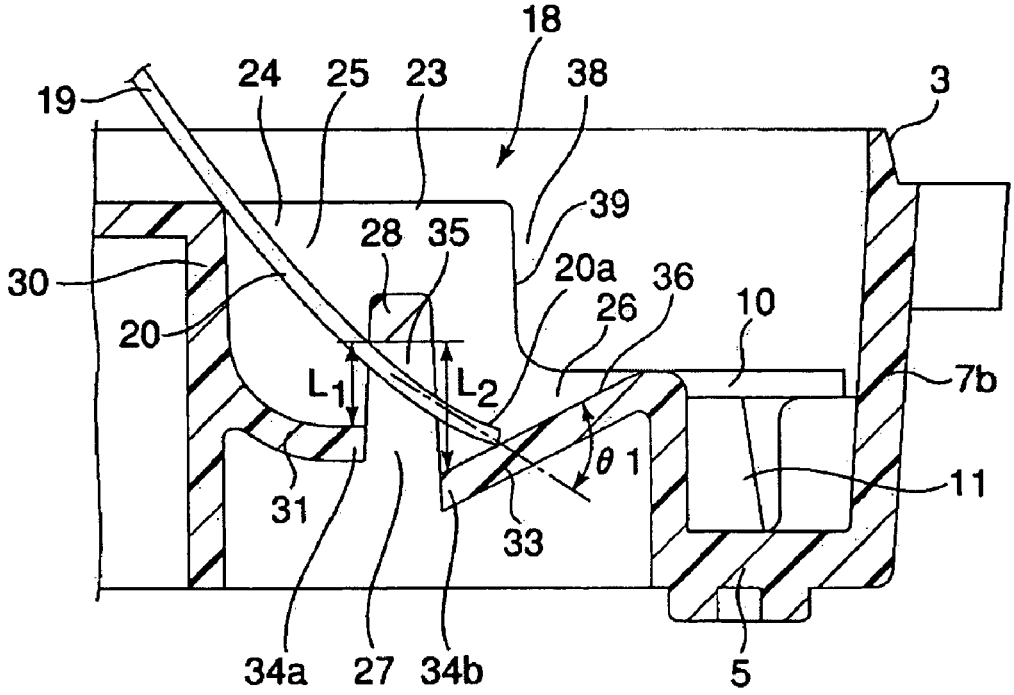
FIG. 5 is an exemplary cross-section view of a band attachment part where the tip of a tie-band has been inserted into a lead-out part from an insertion part in conformance with the first embodiment of the present invention.

As shown in FIGS. 3 and 5, the groove 24 includes an insertion part 25, a lead-out part 26, an opening 27, and a tying part 28. The insertion part 25 is positioned on one end of the groove 24. The insertion part 25 has an end wall 30 and a bottom wall 31. The end wall 30 rises between the first wall 7*a* and the opposing wall 23 in a manner spanning the two walls. The bottom wall 31 extends in the width direction of the base 3 between the first wall 7*a* and the opposing wall 23 in a manner spanning the two walls, while also continuing to an intermediate part of the end wall 30 in the height direction.

The lead-out part 26 is positioned on the other end of the groove 24. This lead-out part 26 has a bottom wall 33. The bottom wall 33 extends in the width direction of the base 3 between the first wall 7*a* and the opposing wall 23 in a manner spanning the two walls.

The opening 27 is positioned between the bottom wall 31 of the insertion part 25 and the bottom wall 33 of the lead-out part 26. This opening 27 has a slotted opening shape between the first wall 7*a* and the opposing wall 23, and separates the insertion part 25 and the lead-out part 26 inside the groove 24. Accordingly, the bottom wall 31 of the insertion part 25 has a first end 34*a* that continues to the opening 27, while the bottom wall 33 of the lead-out part 26 has a second end 34*b* that continues to the opening 27.

The tying part 28 has a square bar shape. The tying part 28 lies horizontally in the wiring direction of the cables 14 in such a way that it bridges the first wall 7*a* and the opposing wall 23. Furthermore, the tying part 28 is positioned directly above the opening 27, and faces the opening 27 over a sufficient clearance 35 between itself and the opening 27 through which the tie-band 19 is guided. According to this embodiment, the tying part 28 is integrally formed with the base 3 by injection molding, and therefore the opening 27 is provided as a mold removal hole used to remove the injection molding die.

As shown in FIG. 5, the bottom wall 33 of the lead-out part 26 has a guide surface 36 with which the tip 20*a* of the tie-band 19 slidably makes contact. The guide surface 36 is exposed to the interior of the groove 24 and tilts toward a position above the groove 24 in a straight line as it moves away from the opening 27 toward the lead-in direction of the tie-band 19.

In this embodiment, the tip 20*a* of the tie-band 19 that has been inserted from the insertion part 25 contacts the guide surface 36 at an angle $\theta 1$ smaller than 90° ($\theta 1<90°$). In other words, the guide surface 36 tilts in such a way that the tip 20*a* of the tie-band 19 contacts the surface at an angle $\theta 1$ smaller than 90°.

In addition, the second end 34*b* of the lead-out part 26 is positioned below the first end 34*a* of the insertion part 25. For this reason, the second end 34*b* is offset from the first end 34*a* in the direction of moving away from the tying part 28. As a result, the distance L1 from the tying part 28 to the first end 34*a* is shorter than the distance L2 from the tying part 28 to the second end 34*b*.

As shown in FIGS. 3 through 6, the second wall 7*b* of the base 3 is positioned alongside the lead-out part 26 of the band attachment part 18 in the lead-out direction of the tie-band 19. According to this embodiment, the tip 20*a* of the tie-band 19 contacts the second wall 7*b* at an angle $\theta 2$ smaller than 90° ($\theta 2<90°$) when the tip 20*a* of the tie-band 19 is led out from the groove 24 through the lead-out part 26.

The opposing wall 23 of the band attachment part 18 includes a notch 38 in a position corresponding to the lead-out part 26. The notch 38 has a rim 39 that extends in the height direction of the base 3 in a manner crossing with the wiring direction of the cables 14 roughly at right angles. This rim 39 extends toward the direction of the lead-out part 26 from the tying part 28.

Next, the operations for retaining the plurality of cables 14 by tying them at the band attachment part 18 of the base 3 are explained.

To retain the plurality of cables 14 at the band attachment part 18, remove the top cover 4 from the base 3 to expose the band attachment part 18. The plurality of cables 14 are guided into the base 3 from the cable lead-in hole 15 and let travel across the groove 24 and through the notch 38 provided in the opposing wall 23.

In this condition, the tie-band 19 is inserted into the insertion part 25 from above the band attachment part 18. As shown in FIG. 5, the tie-band 19 is inserted into the insertion part 25 from the tip 20*a* of the band 20. The tip 20*a* of the band 20 travels above the opening 27 between the end wall 30 and the tying part 28 and is guided toward the direction of the lead-out part 26.

At this time, the second end 34*b* of the lead-out part 26 that continue to the opening 27 provided for mold removal is offset downward from the first end 34*a* of the insertion part 25 that also continues to the opening 27. For this reason, after passing above the opening 27 the tip 20*a* of the band 20 contacts the guide surface 36 of the lead-out part 26.

According to this embodiment, the guide surface 36 tilts in such a way that the tip 20*a* of the band 20 contacts the guide surface 36 at an angle θ1 smaller than 90°. Therefore, the tip 20*a* of the band 20 is guided upward along the tilted guide surface 36 and thus is prevented from easily bending toward the direction of the opening 27.

As the band 20 is continuously inserted into the insertion part 25, the tip 20*a* of the band 20 is led out through the lead-out part 26 toward the second wall 7*b* of the base 3 along the tilted guide surface 36, as shown in FIG. 6. As a result, the tip 20*a* of the band 20 contacts the second wall 7*b*.

In this embodiment, the tip 20*a* of the band 20 contacts the erect second wall 7*b* at an angle θ2 smaller than 90°, and therefore the tip 20*a* of the band 20 is smoothly guided upward along the second wall 7*b* and projects onto the base 3.

Figure 7:
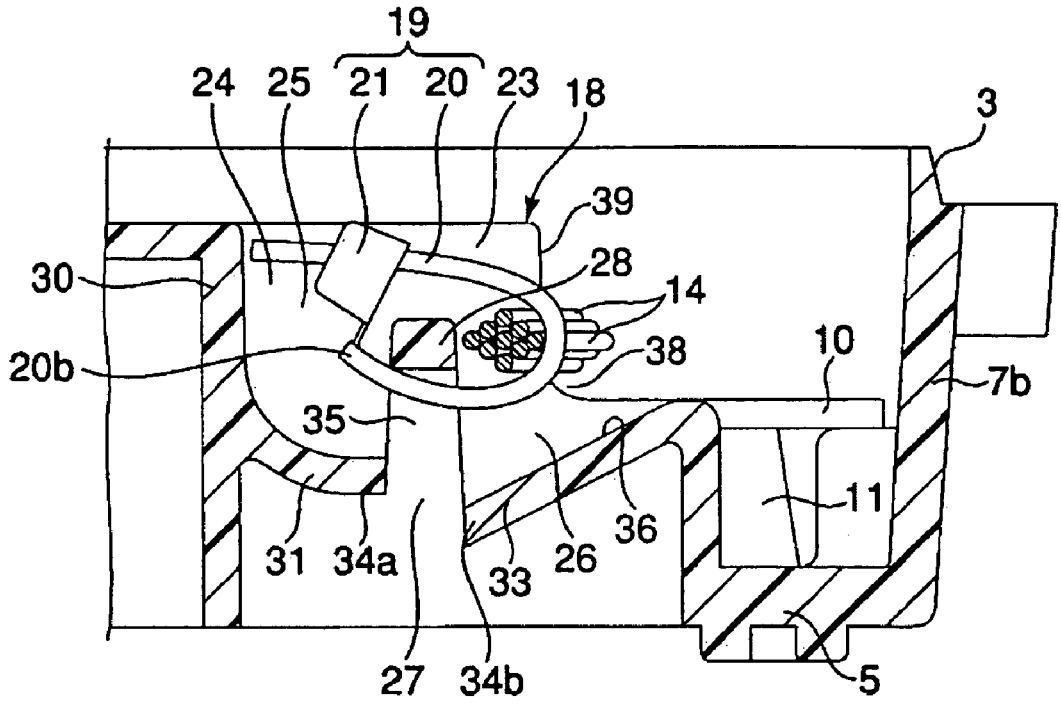
FIG. 7 is an exemplary cross-section view of a band attachment part where a plurality of cables are tied to a tying part using a tie-band in conformance with the first embodiment of the present invention.

Next, the tip 20*a* of the band 20 that has projected onto the base 3 is grabbed with a hand, and then the tip 20*a* of the band 20 is inserted into the latch 21 of the tie-band 19 over the tying part 28, as shown by Arrow A in FIG. 6. This way, the tie-band 19 is looped around the plurality of cables 14 as well as the tying part 28, as shown in FIG. 7.

When the tip 20*a* of the band 20 that has been guided through the latch 21 is pulled, the tie-band 19 is tightened in a manner reducing the diameter of the loop and finally wrapping around the tying part 28. As a result, the tie-band 19, together with the tying part 28, ties the cables 14 into a single bundle, while affixing the cables 14 in a posture conforming to the contour of the tying part 28.

The opposing wall 23 that runs at right angles with the tying part 28 has a notch 38 through which the cables 14 are guided, and the rim 39 of this notch 38 extends toward the direction of the lead-out part 26 from the tying part 28. For this reason, when the cables 14 are tied and affixed at the tying part 28, the cables 14 are pushed against the rim 39 of the notch 38 and then pulled diagonally toward the tying part 28 from the rim 39, as illustrated most clearly in FIG. 4.

As a result, the cables 14 are bent in crank shape (e.g., vertically then horizontally) at the location of the notch 38, and this has the effect of preventing the cables 14 from shifting easily along the axial direction.

According to this first embodiment of the present invention, when the tie-band 19 is inserted into the insertion part 25, the tip 20*a* of the tie-band 19 does not easily enter the opening 27 provided for mold removal and consequently the tip 20*a* can be reliably received by the guide surface 36.

Furthermore, the guide surface 36 tilts upward in the direction of moving away from the opening 27, and accordingly the tip 20*a* of the tie-band 19 contacts the guide surface 36 at an angle (θ1) smaller than 90°. Therefore, the tie-band 19 does not bend toward the direction of the opening 27, but instead it is reliably guided toward a position above the lead-out part 26, as the tie-band 19 is inserted continuously into the insertion part 25.

In addition, after having been led out onto the lead-out part 26 the tip 20*a* of the tie-band 19 contacts the second wall 7*b* of the base 3 at an angle (θ2) smaller than 90°. Therefore, the tip 20*a* of the tie-band 19 projects smoothly toward a position above the base 3 and this tip 20*a* can be easily grabbed with fingers.

As a result, the tie-band 19 can be looped around the tying part 28 with ease, and this improves the operability of tying the cables 14 to the tying part 28.

At the same time, the insertion path of the tie-band 19 is determined with respect to the band attachment part 18, and this permits secure tying of the cables 14 using the tie-band 19. Because of this, the cables 14 do not shift easily from the tying part 28, and consequently the cables 14 can be securely affixed at a specified position in the enclosure 2.

Figure 8:
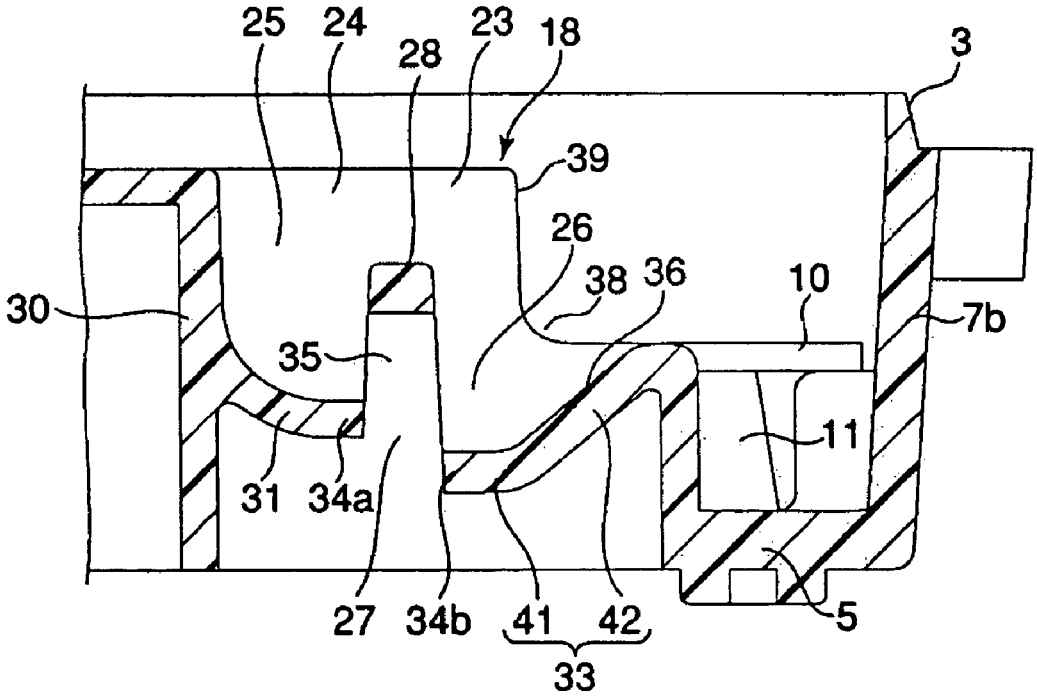
FIG. 8 is an exemplary cross-section view of a band attachment part conforming to the second embodiment of the present invention.

Now, attention is drawn to the fact that the present invention is not specifically limited to the first embodiment explained above. FIG. 8 discloses the second embodiment of the present invention.

In this second embodiment, the shape of the bottom wall 33 of the lead-out part 26 is different from the shape in the aforementioned first embodiment, but the remainder of the band attachment 18 is the same as the configuration explained in the first embodiment.

As shown in FIG. 8, the bottom wall 33 includes a horizontal part 41 that extends to the second wall 7*b* from the second end 34*a* continuing to the opening 27, and a tilted part 42 that tilts upward as the wall continues from the horizontal part 41 toward the second wall 7*b*. The boundary of the horizontal part 41 and the tilted part 42 is warped in arc shape to prevent the tip 20*a* of the tie-band 19 from getting caught.

This configuration also allows the tip 20*a* of the tie-band 19 that has been inserted from the insertion part 25 of the band attachment part 18 to be reliably received by means of the horizontal part 41 or tilted part 42 of the bottom wall 33. Accordingly, the tip 20*a* of the tie-band 19 does not easily enter the opening 27 provided for mold removal, and consequently the tie-band 19 can be inserted easily into the band attachment part 18.

Figure 9:
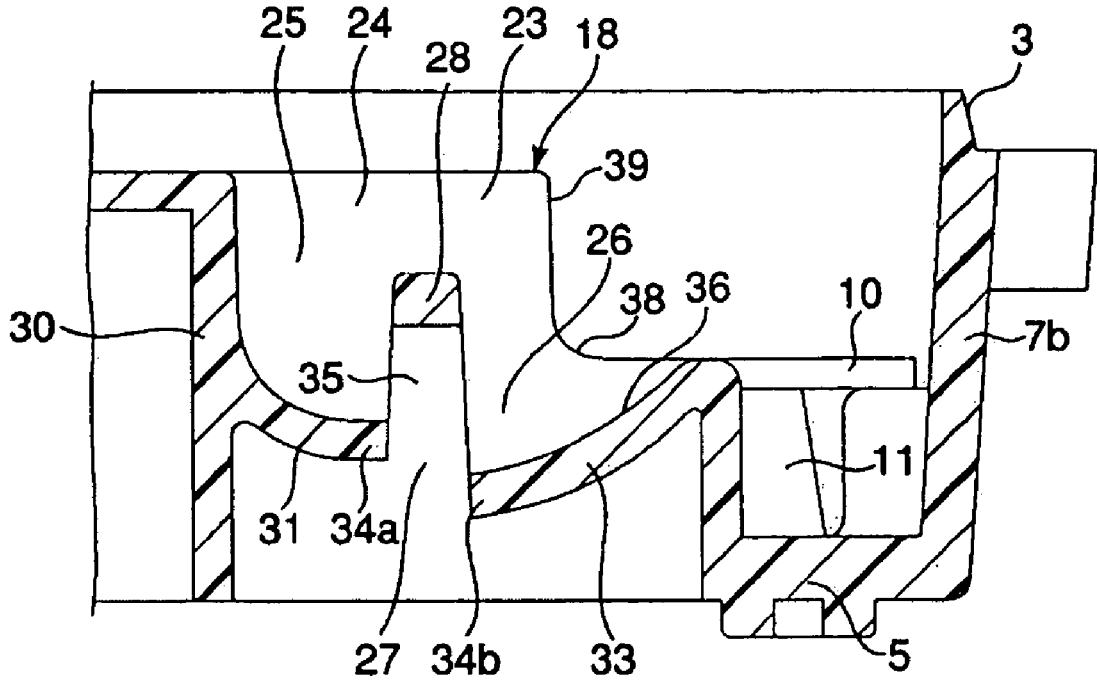
FIG. 9 is an exemplary cross-section view of a band attachment part conforming to the third embodiment of the present invention.

FIG. 9 discloses the third embodiment of the present invention.

This third embodiment is different from the aforementioned first embodiment in that the bottom wall 33 of the lead-out part 26 is warped in arc shape, and the remainder of the band attachment 18 is the same as the configuration explained in the first embodiment.

According to this third embodiment, the warped bottom wall 33 of the lead-out part 26 further prevents the tip 20*a* of the tie-band 19 from bending toward the direction of the opening 27. This structure provides the benefit of allowing the tip 20*a* of the tie-band 19 to be guided smoothly toward a position above the groove 24.

It should be noted further that the present invention can be applied not only to control boxes connected to telephone lines, but also to other types of electronic devices such as information processing devices.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cable tying apparatus comprising:

a band attachment part including (i) an insertion part where a tie-band for tying cables is inserted, (ii) a lead-out part where the tie-band inserted into the insertion part is led out, and (iii) an opening that separates the insertion part and the lead-out part; and a tying part installed on the band attachment part in a manner facing the opening and providing a clearance through which the tie-band is guided, wherein the insertion part includes a first end that continues to the opening, while the lead-out part includes a second end that continues to the opening, and the second end is offset from the first end in a direction away from the tying part.

2. The cable tying apparatus according to claim 1, wherein the lead-out part includes a guide surface with which the tie-band slidably makes contact, and the guide surface tilts in the direction of approaching the tying part as it moves away from the opening.

3. The cable tying apparatus according to claim 2, wherein the tip of the tie-band contacts the guide surface of the lead-out part at an angle smaller than 90° when the tie-band is inserted from the insertion part and guided through the clearance to the lead-out part.

4. The cable tying apparatus according to claim 2, wherein the guide face of the lead-out part tilts in a manner allowing the tip of the tie-band to make contact at an angle smaller than 90°.

5. The cable tying apparatus according to claim 1, wherein the lead-out part has a guide surface with which the tie-band slidably makes contact, and the guide surface warps in arc shape in the direction of approaching the tying part as it moves away from the opening toward the lead-in direction of the tie-band.

6. The cable tying apparatus according to claim 5, wherein the tip of the tie-band contacts the guide surface of the lead-out part at an angle smaller than 90° when the tie-band is inserted from the insertion part and guided through the clearance to the lead-out part.

7. The cable tying apparatus according to claim 1, further comprising a wall with which the tip of the tie-band makes contact at an angle smaller than 90° when the tie-band is led out from the band attachment part through the lead-out part.

8. The cable tying apparatus according to claim 1, wherein the tying part includes a bar that extends along a wiring direction of the cables, while the band attachment part includes a wall that extends toward the direction of the lead-out part from the tying part, so that when the cables are tied along the tying part by the tie-band, the cables contact the rim of the wall and bend downward before extending horizontally.

9. An electronic device comprising:

an enclosure;

a band attachment part installed in the enclosure for tying cables and having an insertion part where a tie-band is inserted, a lead-out part where the tie-band inserted into the insertion part is led out, and an opening that separates the insertion part and the lead-out part; and a tying part facing the opening and providing a clearance between itself and the opening through which the tie-band is guided;

wherein the insertion part includes a first end that continues to the opening, while the lead-out part includes a second end that continues to the opening, and the second end is offset from the first end in a direction away from the tying part.

10. The electronic device according to claim 9, wherein the lead-out part includes a guide surface with which the tie-band slidably makes contact, and the guide surface tilts in the direction of approaching the tying part as it moves away from the opening toward the lead-in direction of the tie-band.

11. The electronic device according to claim 10, wherein the tip of the tie-band contacts the guide surface of the lead-out part at an angle smaller than 90° when the tie-band is inserted from the insertion part and guided through the clearance to the lead-out part.

12. The electronic device according to claim 10, wherein the guide face of the lead-out part tilts in a manner allowing the tip of the tie-band to make contact at an angle smaller than 90°.

13. The electronic device according to claim 9, wherein the lead-out part includes a guide surface with which the tie-band slidably makes contact, and the guide surface is formed in an arc shape in the direction of approaching the tying part as it moves away from the opening toward the lead-in direction of the tie-band.

14. The electronic device according to claim 13, wherein the tip of the tie-band contacts the guide surface of the lead-out part at an angle smaller than 90° when the tie-band is inserted from the insertion part and guided through the clearance to the lead-out part.

15. The electronic device according to 9, wherein the enclosure includes a wall with which the tip of the tie-band makes contact at an angle smaller than 90° when the tie-band is led out from the band attachment part through the lead-out part.

16. An electronic device according to 9, wherein the band attachment part is molded integrally with the enclosure and the opening is provided as a mold removal hole that opens toward the outside of the enclosure.

17. An electronic device according to 9, wherein the tying part includes a bar that extends along a wiring direction of the cables, while the band attachment part includes a wall that extends toward the direction of the lead-out part from the tying part, so that when the cables are tied along the tying part by the tie-band, the cables contact the rim of the wall and bend before continuing in the wiring direction.

18. A cable tying apparatus comprising:

a band attachment part including an opening to receive a tie-band for tying cables is inserted, the opening separating an insertion part and a lead-out part; and a tying part coupled to the band attachment part, the tying part providing a clearance to a bottom wall of the insertion part and a bottom wall of the lead-out part through which the tie-band is guided, wherein the insertion part includes a first end that continues to the opening, while the lead-out part includes a second end that continues to the opening, and the second end is offset from the first end in a vertical direction away from the tying part.

19. The cable tying apparatus according to claim 18, wherein the lead-out part includes a guide surface with which the tie-band slidably makes contact, and the guide surface tilts in an upward direction away from the opening.

20. The cable tying apparatus according to claim 19, wherein the tip of the tie-band contacts the guide surface of the lead-out part at an angle smaller than 90° when the tie-band is inserted from the insertion part and guided through the clearance to the lead-out part.

* * * * *